US007331846B1

(12) United States Patent
Shimizu et al.

(10) Patent No.: US 7,331,846 B1
(45) Date of Patent: Feb. 19, 2008

(54) BLASTING APPARATUS FOR OUTER SURFACE OF PIPE

(75) Inventors: Tokuo Shimizu, Tokyo (JP); Tetsunori Yano, Tokyo (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 0 days.

(21) Appl. No.: 11/463,184

(22) Filed: Aug. 8, 2006

(30) Foreign Application Priority Data

Aug. 17, 2005 (JP) ..... 2005-236649

(51) Int. Cl.
*B24C 3/06* (2006.01)

(52) U.S. Cl. ..... 451/92; 451/87; 451/89

(58) Field of Classification Search ..... 451/92, 451/75, 89, 87, 456
See application file for complete search history.

(56) References Cited

U.S. PATENT DOCUMENTS 4,007,705 A 2/1977 Sherer et al.
4,016,681 A * 4/1977 Leliaert ..... 451/76
4,716,271 A 12/1987 Hulsizer et al.
5,069,234 A * 12/1991 Nielsen ..... 134/113
5,136,969 A * 8/1992 Chapman ..... 118/305
5,199,226 A * 4/1993 Rose ..... 451/36
5,385,609 A * 1/1995 Rose et al. ..... 118/119
5,743,969 A * 4/1998 Lawler ..... 134/10
7,059,945 B2 6/2006 Skinner

FOREIGN PATENT DOCUMENTS

EP 0214841 A2 3/1987
EP 0710511 A1 8/1995
JP 9-109029 4/1997

OTHER PUBLICATIONS

European Search Report dated Nov. 28, 2006.

* cited by examiner

*Primary Examiner*—Dung Van Nguyen
(74) *Attorney, Agent, or Firm*—David S. Safran

(57) ABSTRACT

The present invention provides a blasting apparatus for an outer surface of a pipe which ejects a blast material to an outer side of a pipe and grinds the outer surface, comprising: a blast head containing a nozzle which ejects the blast material and a suction port which sucks a blast material used for grinding and dust particles; a guide member which is provided along a longitudinal direction of the outer surface of the pipe, and guides the blast head along the longitudinal direction of the outer surface of the pipe; and a ring member which is a ring member constructed by connecting at least two half-split members and having an inside diameter larger than an outside diameter of the pipe, and which is disposed to have the pipe inserted through the ring member, holds the guide member, and guides the blast head in a circumferential direction of the outer surface of the pipe by turning in the circumferential direction on the outer surface of the pipe.

8 Claims, 8 Drawing Sheets

BLASTING APPARATUS FOR OUTER SURFACE OF PIPE

BACKGROUND OF THE INVENTION

1. Field of the Invention

The present invention relates to a blasting apparatus, and more particularly, relates to a blasting apparatus for an outer surface of a pipe, which ejects a blast material to an outer surface of a pipe and grinds the outer surface of the pipe to perform surface preparation.

2. Description of the Related Art

For example, a vent pipe (piping) placed inside a suppression chamber, which is a part of a nuclear reactor containment facility of an atomic power plant, has its outer peripheral surface and inner peripheral surface coated by recoating it with a plurality of coating materials excellent in corrosion resistance, decontaminability and the like. The repainting construction is carried out with about 10 years after the start of operation as a guide, and as a pre-construction of the repainting construction, grinding and decontaminating operations of grinding the coating film including radioactive substances on the outer peripheral surface and the inner peripheral surface and roughening the coated surface to perform surface preparation are performed.

Conventionally, no apparatus for grinding and decontaminating the inner peripheral surface of a vent pipe is available, and grinding and decontaminating of only the outer peripheral surface is carried out by a blasting technique. The blasting technique is a technique of causing a blast material such as sand, and steel grit ejected by high speed air to collide against a substance to be treated, grinding the surface of the substance to be treated with the impact force to roughen the surface (for example, see Japanese Patent Application Laid-Open No. 9-109029).

SUMMARY OF THE INVENTION

However, since the sand blasting technique as described in the above described Japanese Patent Application Laid-Open No. 9-109029 adopts the method of a worker moving a blast ejection nozzle on a surface to be treated by gripping the blast ejection nozzle, it is inefficient, and has the problem in hygiene.

Further, the worker performs an operation as he or she makes one round of a pipe, and there is the problem that when the pipe is laterally arranged, operability becomes extremely bad, and when the pipe is close to a wall surface even if it is vertically arranged, operability also degrades.

The present invention is made in view of the above circumstances, and has an object to provide a blasting apparatus for an outer surface of a pipe, which is capable of efficiently grinding the outer surface of a pipe with excellent operability.

In order to attain the above-described object, the invention according to a first aspect provides a blasting apparatus for an outer surface of a pipe, in a blasting apparatus for an outer surface of a pipe which ejects a blast material to an outer side of a pipe and grinds the outer surface, characterized by including a blast head containing a nozzle which ejects the blast material and a suction port which sucks a blast material used for grinding and dust particles, a guide member which is provided along a longitudinal direction of the outer surface of the pipe, and guides the blast head along the longitudinal direction of the outer surface of the pipe, and a ring member which is a ring member constructed by connecting at least two half-split members and having an inside diameter larger than an outside diameter of the pipe, and which is disposed to have the pipe inserted through the ring member, holds the guide member, and guides the blast head in a circumferential direction of the outer surface of the pipe by tuning in the circumferential direction on the outer surface of the pipe.

According to the invention described in the first aspect, the blast head containing the nozzle which ejects the blast material, and the suction port which sucks the blast material used for grinding and dust particles is guided along the longitudinal direction of the outer surface of the pipe by the guide member provided along the longitudinal direction of the outer surface of the pipe, and is guided along the circumferential direction of the outer surface of the pipe by the ring member which is disposed to have the pipe inserted through the ring member. Therefore, the blast head can be easily moved along the longitudinal direction and the circumferential direction of the outer surface of the pipe with a simple mechanism, and the blasting treatment of the outer surface of the pipe can be efficiently performed under the clean environment.

Further, the ring member is constructed by the member which is divided into at least two, and therefore, the ring member is easily attached to and detached from the pipe. Operability at the time of changing setting in the longitudinal direction past the support portion which supports the pipe is especially excellent.

In the invention of the first aspect, the invention according to a second aspect is characterized by further including a longitudinally driving device which moves the blast head along the longitudinal direction of the outer surface of the pipe, and a circumferentially driving device which moves the blast head along the circumferential direction of the outer surface of the pipe, and in that the longitudinally driving device is constructed by one guide member, one feed screw provided parallel with the one guide member, a nut which is threadedly fitted onto the feed screw and connected to the blast head, and a drive device which rotationally drives the feed screw, and the circumferentially driving device is constructed by the ring member, a large-diameter gear provided integrally with the ring member, a small-diameter gear which is meshed with the large-diameter gear, and a drive device which rotationally drives the small-diameter gear.

According to the invention described in the second aspect, the longitudinally driving device having the one guide member and the one feed screw which is rotationally driven by the drive device, and the circumferentially driving device having the ring member, the large-diameter gear provided at the ring member, and the small-diameter gear which is rotationally driven by the drive device are provided, and therefore, the movement of the blast head in the longitudinal direction of the outer surface of the pipe and its movement in the circumferential direction can be automated with a simple mechanism.

The invention according to a third aspect provides a blasting apparatus for an outer surface of a pipe, in a blasting apparatus for an outer surface of a pipe which ejects a blast material to an outer side of a pipe and grinds the outer surface, characterized by including a blast head containing a nozzle which ejects the blast material and a suction port which sucks a blast material used for grinding and dust particles, and in that the blast head is constructed by connecting at least two half-split members, formed into a ring shape having an inside diameter larger than an outside diameter of the pipe, and disposed to have the pipe inserted though the blast head, and a plurality of spherical rolling seats which abut on the outer surface of the pipe and guide the blast head movably in a longitudinal direction and a circumferential direction of the outer surface of the pipe are provided on the inside diameter side of the blast head.

According to the invention described in the third aspect, the ring-shaped blast head disposed to have the pipe inserted through the blast head is provided with a plurality of spherical rolling seats which abut on the outer surface of the blast head, and therefore, the blast head can be moved along the longitudinal direction and the circumferential direction of the outer surface of the pipe with a simple structure.

Since the blast head is constructed by the member which is divided into at least two, the blast head is easily attached to and detached from the pipe. Operability when setting is changed in the longitudinal direction past the support portion which supports the pipe is especially excellent.

In the invention in the third aspect, the invention according to a fourth aspect is characterized by further including a longitudinally driving device which moves the blast head along the longitudinal direction of the outer surface of the pipe, and a circumferentially driving device which moves the blast head along the circumferential direction of the outer surface of the pipe, and in that the longitudinally driving device is constructed by one feed screw provided parallel with the longitudinal direction of the outer surface of the pipe, a feed nut which is threadedly fitted onto the feed screw and connected to the blast head so as to restrain only movement of the blast head in the longitudinal direction of the outer surface of the pipe, and a drive device which rotationally drives the feed screw, and the circumferentially driving device is constructed by a large-diameter gear provided integrally with the blast head formed into the ring shape, a small-diameter gear which is meshed with the large-diameter gear held by the feed nut, and a drive device which rotationally drives the small-diameter gear.

According to the invention described in the fourth aspect, the longitudinally driving device having the one feed screw which is rotationally driven by the driving device, and the circumferentially driving device having the large-diameter gear provided integrally with the blast head and the small-diameter gear rotationally driven by the air motor are provided, and therefore, the movement of the blast head in the longitudinally direction and its movement in the circumferential direction of the outer surface of the pipe can be automated.

In the invention according to the invention of any one of the first, second, third and fourth aspects, the invention according to a fifth aspect is characterized by having an illuminating device which illuminates a base of the outer surface of the pipe ground by the blast material, and an image pickup device which picks up an image of the base of the outer surface of the pipe illuminated by the illuminating device.

According to the invention described in the fifth aspect, the image of the base of the outer surface of the pipe after blasting can be picked up. Therefore, the rust removal degree and the ground state can be observed, the finished state can be recorded, and the finished state can be compared with a sample and automatically judged.

In the invention of any one of the first, second, third, fourth and fifth aspects, the invention according to a sixth aspect is characterized in that the blast material is a blast medium in a sponge piece form in which abrasives are contained in a porous elastic body.

According to the invention described in the sixth aspect, the blast medium in the sponge piece form in which the abrasives are contained in the porous elastic body is used as the blast material. When the blast medium collides against the outer surface of the pipe, the blast medium becomes flat, and the contained abrasives directly collide against the outer surface at a high speed. Therefore, the outer surface can be ground as in a sand blasting technique. The dust particles which float in the air in the ordinary sand blasting are taken into the sponge pieces and directly drop. Therefore, scattering of the dust particles can be significantly reduced, and the operation environment can be remarkably improved.

According to the blasting apparatus for an outer surface of a pipe of the present invention, the blast head containing the nozzle which ejects the blast material and the suction port which sucks the blast material used for grinding and the dust particles is guided to be movable in the longitudinal direction and the circumferential direction of the outer surface of the pipe. Therefore, the used blast material and dust particles can be sucked, the blast head can be easily moved along the outer peripheral surface of the pipe with a simple mechanism, and blasting treatment of the outer surface of the pipe can be efficiently performed under the clean environment.

DETAILED DESCRIPTION OF THE PREFERRED EMBODIMENTS

A preferred embodiment of a blasting apparatus for an outer surface of a pipe according to the present invention will now be described in detail with reference to the accompanying drawings. In this embodiment, explanation will be made with an example of a sponge blasting apparatus using a blast medium in a sponge piece form in which abrasives are contained in a porous elastic body as a blast material. The same members are assigned with the same numerals and characters in each drawing.

Figure 1:
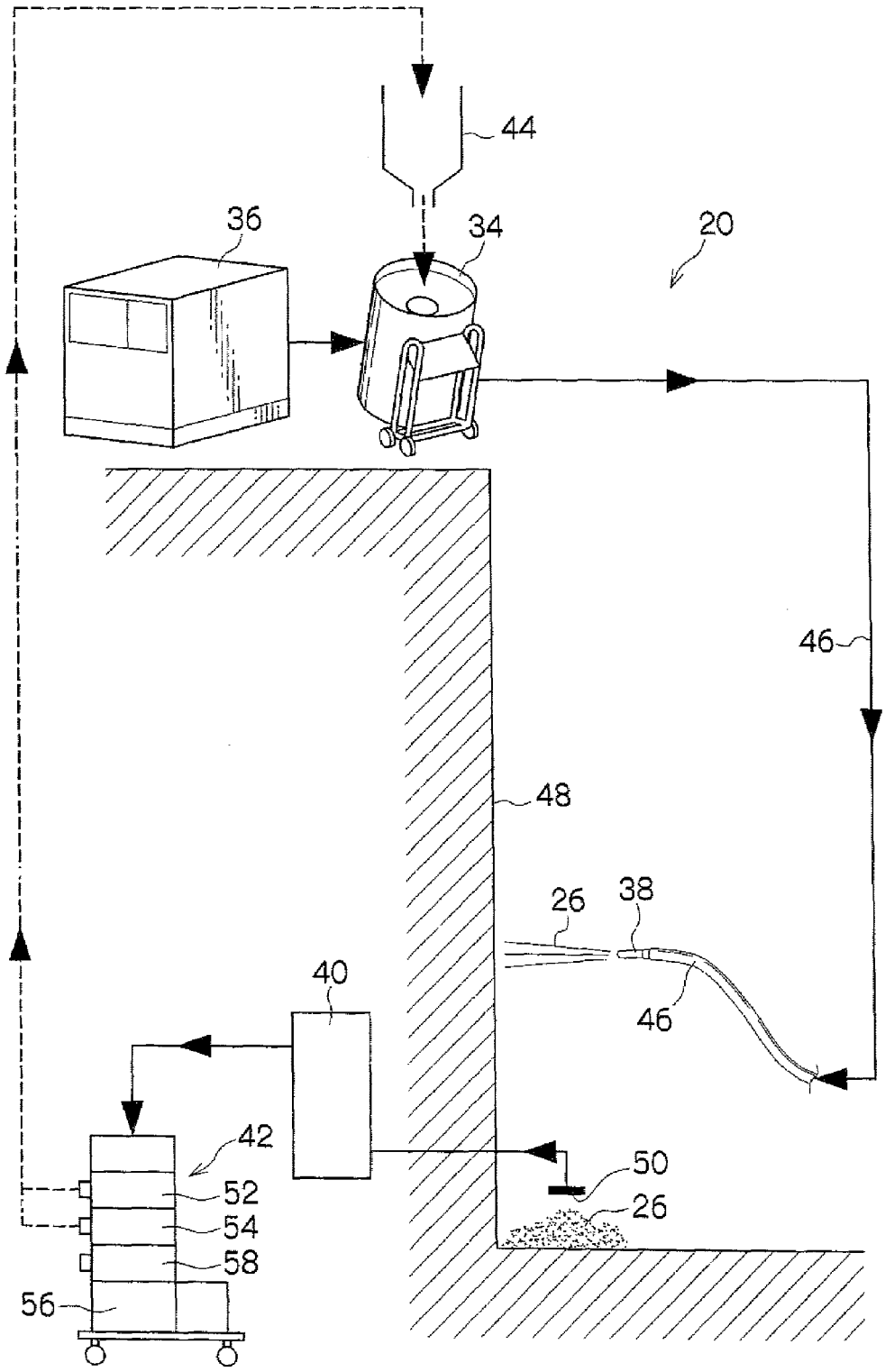
FIG. 1 is an explanatory view showing a basic construction of a sponge blasting apparatus.
Figure 2A:
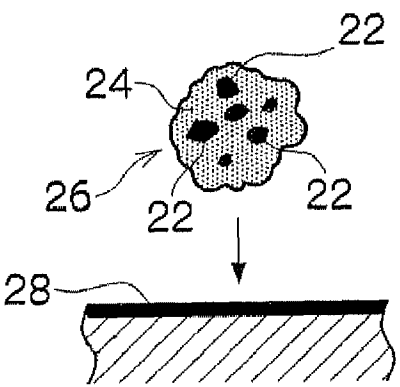
FIGS. 2A to 2C are views explaining a mechanism of sponge blasting.
Figure 2B:
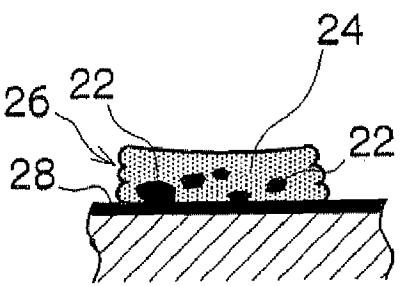
Figure 2C:
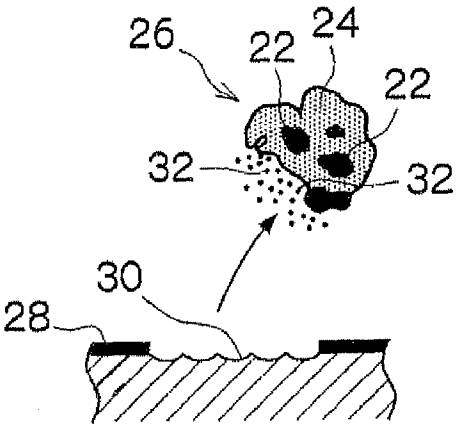

FIG. 1 is an explanatory view showing a basic structure of a sponge blasting apparatus 20 which is applied to the blasting apparatus for an outer surface of a pipe of the embodiment. Explaining the sponge blasting technique using the sponge blasting apparatus 20 first, the blast medium 26 as the blast material used in this technique is made by sticking abrasives (also called a grinding material in the case of an urea resin) of a different material (steel grit, alumina, star light, an urea resin and the like) in accordance with the use purpose to a sponge piece 24 (porous elastic body) as shown in FIGS. 2A to 2C. The blast media 26 are ejected to a coating film 28 by high pressure air, grind the coating film 28 and roughen the coated surface 30 to perform surface preparation.

For example, when the coating film 28 is contaminated with radioactive ray as a vent pipe placed inside a suppression chamber which is a part of an atomic reactor containment facility of an atomic power plant, the coated surface 30 can be decontaminated by the blast media 26.

According to the sponge blasting technique, when the blast media 26 collide against the coating film 28 as shown in FIG. 2A, the blast media 26 become flat as shown in FIG. 2B, and the abrasives 22, 22 contained therein directly collide against the coating film 28 at a high speed. Thereby, as in the sand blasting technique, the coating film 28 can be ground as in FIG. 2C.

Further, dust particles 32, 32, which float in the air in an ordinary sand blasting technique, are taken into the sponge pieces 24 and directly drop, and therefore, scattering of dust particles can be prevented. Further, the repulsive force is also absorbed by the sponge pieces 24, and therefore, rebound of the blast media 26 can be suppressed.

The sponge blasting apparatus 20 is constructed by a sponge blast supply device 34, a compressor 36, a nozzle 38, a suction machine 40, a recycle separator 42 and a hopper 44, as shown in FIG. 1.

High pressure air is supplied from the compressor 36 and the blast media 26 (see FIG. 2A) is supplied from the hopper 44 to the sponge blast supply device 34. The blast media 26 are ejected to a target 48 at a high speed from a tip end of the nozzle 38 by being transported by air via the hose 46 by the high pressure air from the compressor 36. The used blast media 26 directly drop in a state in which dust particles 32, 32 (see FIG. 2C) are taken therein, are sucked into the suction machine 40 through a suction port 50 placed in the vicinity of the drop position, and fed into the recycle separator 42.

The recycle separator 42 is constructed by stacking two sieves 52 and 54, which respectively have sieve openings of large and medium sizes, in layer on a vibration generator 56. The blast media 26 are first fed into the sieve 52 with the large sieve openings, and the sieve 52 is vibrated by the vibrator of the vibration generator 56, whereby the large-sized blast media 26 are separated and taken out from the sieve 52. The blast media 26 which pass through the sieve 52 drop into the sieve 54, and the medium-sized blast media 26 are separated and taken out by the sieve 54 which is similarly vibrated by the vibrator.

The large-and medium-sized blast media 26 removed from the sieves 52 and 54 can be directly used, and therefore, they are conveyed to the hopper 44. Fine blast media 26 which pass through the sieve 54 are not reusable, and therefore, stored in a container 58 and discarded. Reusable blast media 26 constitute about 90% of the entire blast media 26. The above is the basic structure of the sponge blasting apparatus 20.

Figure 3:
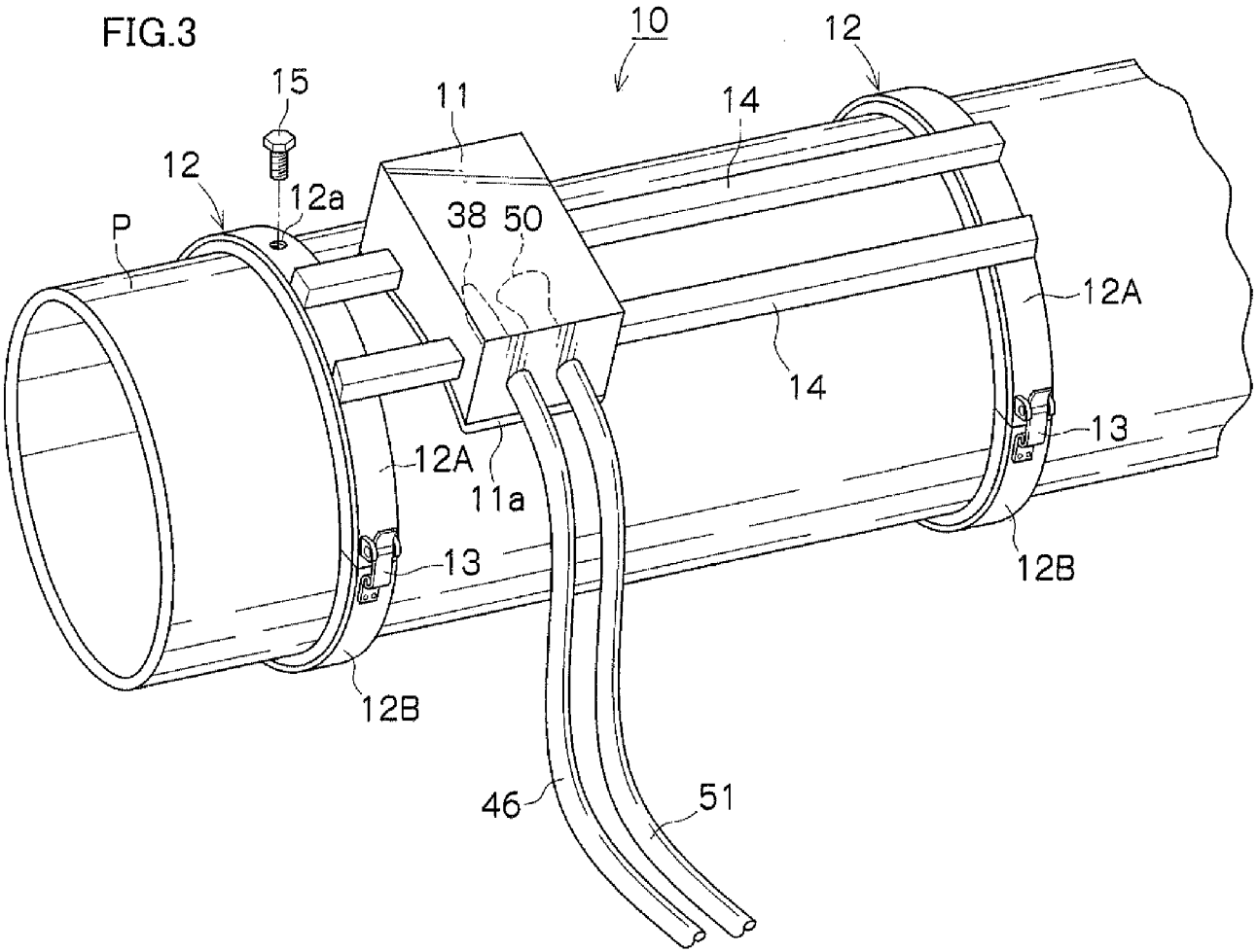
FIG. 3 is a perspective view showing a blasting apparatus for an outer surface of a pipe according to a first embodiment of the present invention.

FIG. 3 is a perspective view showing a first embodiment of a blasting apparatus for an outer surface of a pipe which uses the sponge blasting apparatus 20. A blasting apparatus 10 for an outer surface of a pipe according to the first embodiment is constructed by a blast head 11, a pair of ring members 12 and 12 which encircle an outer periphery of a pipe P, two guide members 14 and 14 which are mounted to the ring members 12 and 12 and guide the blast head 11 along a longitudinal direction of the outer surface of the pipe P, and the like.

In the blast head 11, a nozzle 38 and a suction port 50 of the sponge blasting apparatus 20 are mounted inside its casing. The nozzle 38 is connected to a flexible hose 46, and ejects the sponge blast 26 to the outer surface of the pipe P from its tip end. The suction port 50 is connected to a flexible hose 51, sucks the used blast media 26, and feeds the blast media 26 to the recycle separator 42 via the suction machine 40. A seal member 11*a* made of an elastic material such as rubber is mounted to a region of the blast head 11 in contact with the outer surface of the pipe P.

A pair of ring members 12 and 12 have their inside diameters formed to be slightly larger than an outside diameter of the pipe P, are rotatable in a circumferential direction along the outer periphery of the pipe P, and are each constructed by one member 12A and the other member 12B which are made by dividing the entire ring member. The one member 12A and the other member 12B are set to the pipe P, and are connected with two latch fasteners 13 and 13.

The two guide members 14 and 14 are fixed to a pair of ring members 12 and 12 to be faced to the longitudinal direction of the pipe P, and the blast head 11 are movable along the longitudinal direction of the outer surface of the pipe P by being guided by the guide members 14 and 14. The blast head 11 is rotatable in the circumferential direction of the pipe P together with a pair of ring members 12 and 12 via the guide members 14 and 14.

A screw hole 12*a* is formed in one of a pair of ring members 12 and 12, so that by fastening a fixing screw 15, the ring member 12 is fixed to the pipe P to stop the rotation in the circumferential direction, and by loosening the fixed screw 15, circumferential rotation of the ring member 12 is made possible.

Next, an operation of the blasting apparatus 10 for an outer surface of a pipe constructed above will be described. First, the one members 12A and 12A of a pair of ring members 12 and 12 are fitted to the region to be treated by blasting of the pipe P. Next, the other members 12B and 12B of the ring members 12 and 12 are combined with the one members 12A and 12A, and are respectively connected each with the two latch fasteners 13 and 13 to be made a pair of ring members 12 and 12, and the ring members 12 and 12 are fixed by fastening the fixing screw 15.

The operation of blasting treatment starts from here. First, the blast media 26 are ejected to the outer surface of the pipe P from the nozzle 38, and the used blast media 26 and dust particles are sucked from the suction port 50. In this state, the worker slowly moves the blast head 11 along the longitudinal direction of the outer surface of the pipe P. Blasting treatment of one row is performed by this.

At this time, the seal material 11*a* made of the elastic material such as rubber is mounted to the periphery of the casing opposed to the outer surface of the pipe P of the blast head 11, and therefore, the blast media and dust particles inside the blast head 11 can be prevented from spouting outside.

Next, the fixing screw 15 which fixes the ring member 12 is loosened, the blast head 11 is turned by the amount of the blast width of one row along the circumferential direction of the outer surface of the pipe P, and the fixing screw 15 is fastened. Next, the blast head 11 is slowly moved along the direction opposite to the previous direction in the longitudinal direction of the pipe P to perform blasting treatment of the second row. By repeating the movement of the blast head 11 in the longitudinal direction of the outer surface of the pipe P and its movement in the circumferential direction in this manner, blasting treatment is applied to the entire periphery of the outer surface of the pipe P.

When all the portions in the circumferential direction of the pipe P are blasting-treated, the blasting apparatus 10 for the outer surface of the pipe is moved to the untreated position in the longitudinal direction of the pipe P. At this time, the ring members 12 and 12 have the structure in which they are split into halves, and therefore, when setting is changed in the longitudinal direction past the support portion which supports the pipe P, setting can be easily changed.

In the above described embodiment, the explanation is made with the manual mode in which the movement of the blast head 11 in the longitudinal direction of the outer surface of the pipe P and its movement in the circumferential direction are performed by a worker, but the mode in which a drive mechanism is provided and the blast head 11 is automatically moved can be adopted.

Figure 4:
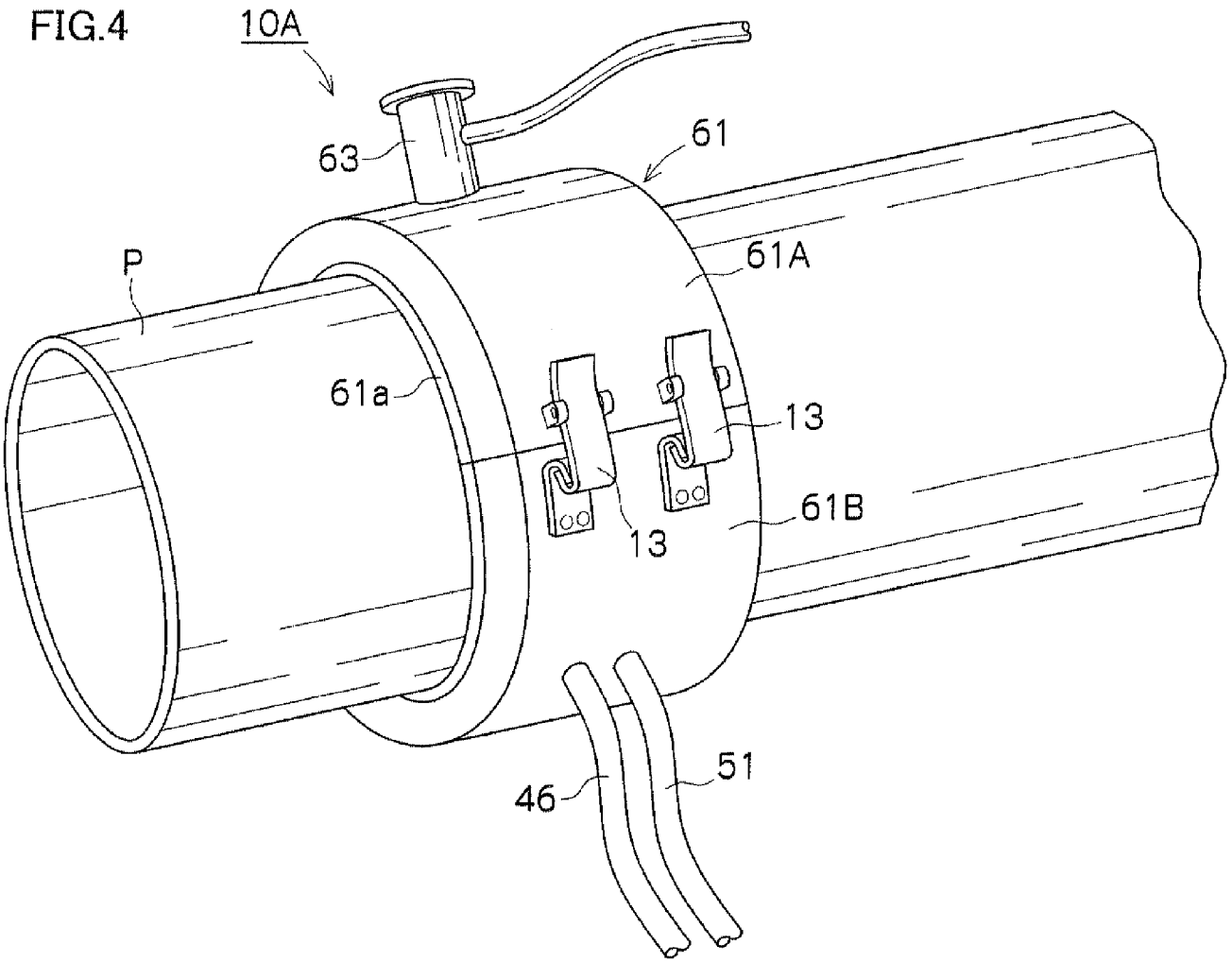
FIG. 4 is a perspective view showing a blasting apparatus for an outer surface of a pipe according to a second embodiment of the present invention.
Figure 5:
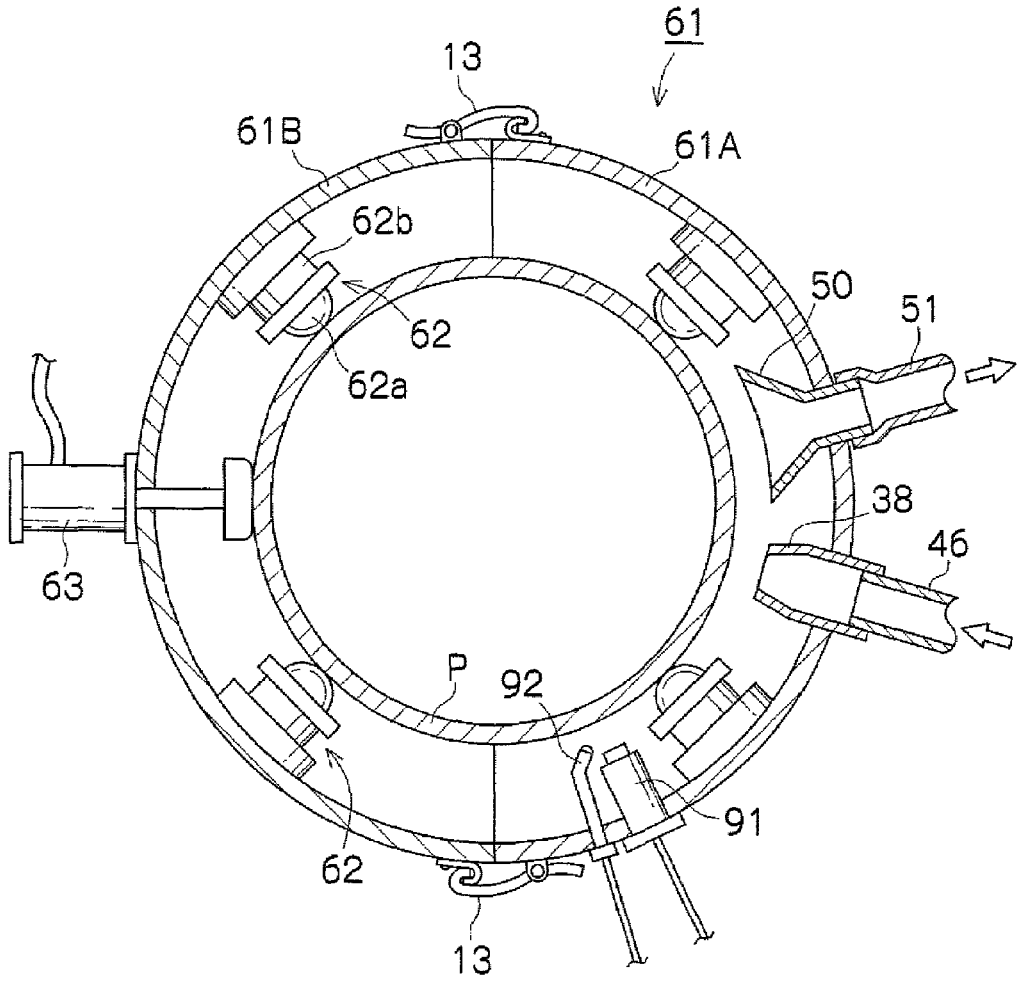
FIG. 5 is a sectional view showing a blasting apparatus for an outer surface of a pipe according to the second embodiment of the present invention.

FIGS. 4 and 5 show a second embodiment, FIG. 4 is a perspective view, and FIG. 5 is a sectional view. In a blasting apparatus 10A for an outer surface of a pipe according to the second embodiment, a blast head 61 itself is constructed to be movable along the longitudinal direction of the outer surface of the pipe P and the circumferential direction of the outer surface of the pipe P.

As shown in FIG. 5, the blast head 61 forms a cylindrical shape, and eight spherical rolling seats 62, 62 in total which are placed in two rows in the width direction at each of the positions where the circumference is divided into four equal parts on the circumference are provided in the casing. A spherical body 62*a* of each of the spherical rolling seats 62 is caused to abut on the outer surface of the pipe P via an elastic member 62*b*, and the blast head 61 is supported movably in the longitudinal direction and the circumferential direction of the pipe P.

The blast head 61 is constructed by one member 61A and the other member 61B which are formed by dividing the entire blast head 61 into two. The one member 61A and the other member 61B are set to the pipe P, and are connected with the four latch fasteners 13 and 13 in total, two of which are placed in the width direction and two of which are placed at the opposed position.

The nozzle 38 and the suction port 50 of the sponge blast apparatus 20 are mounted inside the casing of the blast head 61. The nozzle 38 is connected to the flexible hose 46, and ejects the sponge blast 26 to the outer surface of the pipe P from its tip end. The suction port 50 is connected to the flexible hose 51, and sucks the used blast media 26 and fed them to the recycle separator 42 via the suction machine 40.

A fixing air cylinder 63 is mounted at the position opposed to the nozzle 38 and the suction port 50. The fixing air cylinder 63 is used for securing the present position or the like when the operation is temporarily stopped during the operation, for example. Further, a seal member 61*a* made of an elastic material such as rubber is mounted to the region of the blast head 61, which is in contact with the outer surface of the pipe P.

Further, an illuminating device 92 which illuminates a base of the outer surface of the pipe P which is ground, and an image pickup device 91 which picks up an image of the base of the outer surface of the pipe P illuminated by the illuminating device 92 are provided in the casing of the blast head 61. Thus, the image of the base of the outer surface of the pipe P after blasting can be picked up, and the rust removal degree and the ground state can be observed. Further, the finished state can be recorded, and the finished state can be compared with a sample and judged.

Further, as described above, the blast head 61 is divided into two, and therefore, even when setting is changed in the longitudinal direction past the support portion which supports the long pipe P, setting can changed by dividing the blast head 61. Therefore, setting can be easily changed.

In the case of the second embodiment, the explanation is also made with the manual mode in which the movement of the blast head 11 in the longitudinal direction of the outer surface of the pipe P and its movement in the circumferential direction are performed by a worker, but the mode in which a drive mechanism is provided, and the blast head 11 is automatically moved may be adopted.

Figure 6:
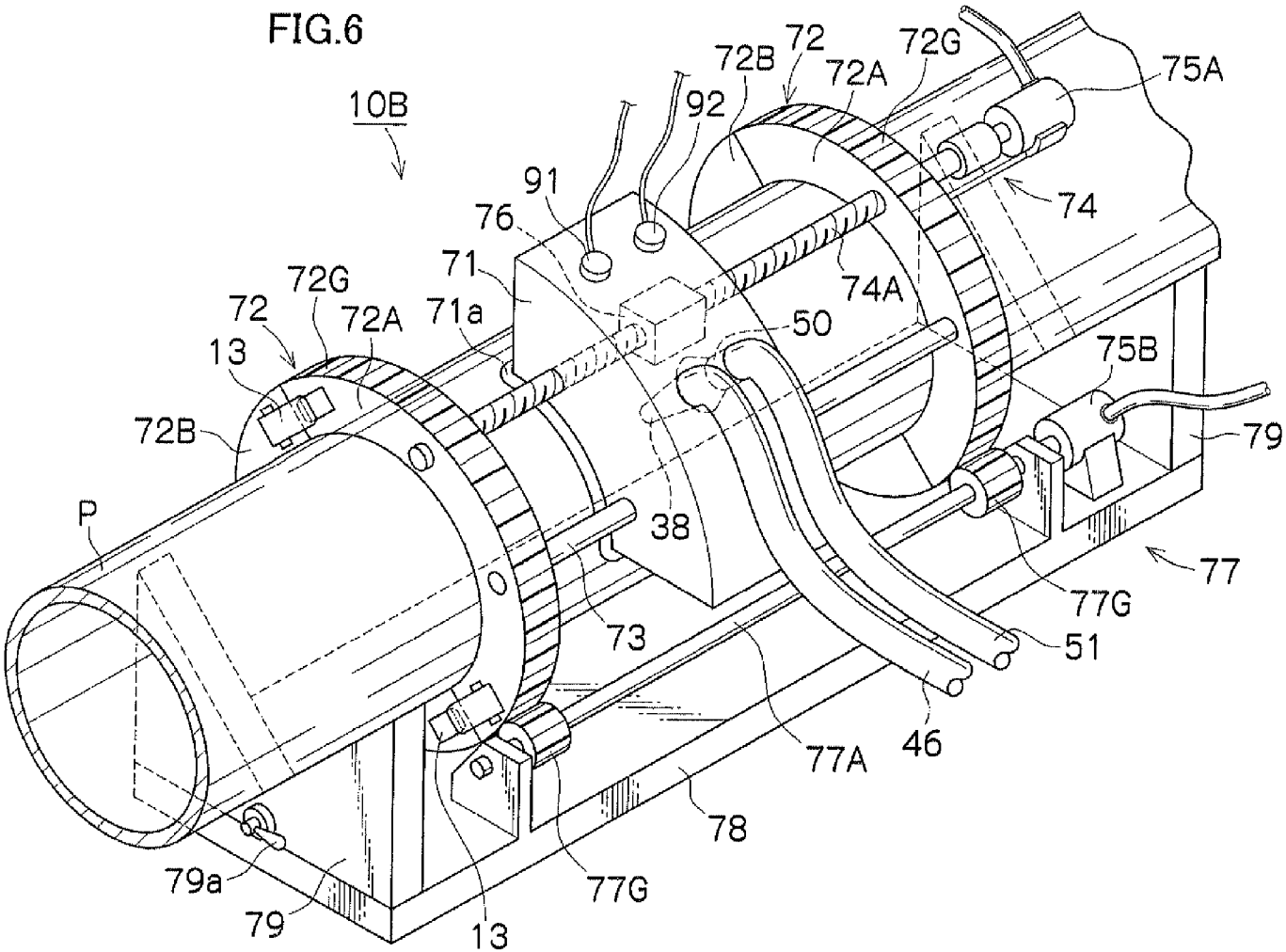
FIG. 6 is a perspective view showing a blasting apparatus for an outer surface of a pipe according to a third embodiment of the present invention.

FIG. 6 is a perspective view showing a third embodiment. A blasting apparatus 10B for an outer surface of a pipe according to the third embodiment is constructed by a blast head 71, a base plate 78, a longitudinally driving device 74 which moves the blast head 71 along the longitudinal direction of the outer surface of the pipe P, a circumferentially driving device 77 which moves the blast head 71 along the circumferential direction of the outer surface of the pipe P, a control device not shown which controls the operation of each part and the like.

The nozzle 38 and the suction port 50 of the sponge blasting apparatus 20 are mounted inside the casing of the blast head 71. The nozzle 38 is connected to the flexible hose 46, and ejects the sponge blast 26 to the outer surface of the pipe P from its tip end. The suction port 50 is connected to the flexible hose 51, and sucks the used blast media 26 and fed them to the recycle separator 42 via the suction machine 40.

A seal material 71*a* made of an elastic material such as rubber is mounted to a region of the blast head 71, which is in contact with the outer surface of the pipe P. Further, the image pickup device 91 and the illuminating device 92 are mounted in the casing of the blast head 71.

The longitudinally driving device 74 is constructed by a guide member 73 mounted to a pair of ring members 72 and 72 which will be described later, a feed screw 74A, a feed nut 76 which is threadedly fitted onto the feed screw 74A and is connected to the blast head 71, an air motor 75A as an explosion-proof type prime mover being a drive device which rotationally drives the feed screw 74A, and the like, as shown in FIG. 6. By reciprocally rotating the feed screw 74A with the air motor 75A, the blast head 71 can be reciprocally moved along the longitudinal direction of the outer surface of the pipe P.

As shown in FIG. 6, the circumferentially driving device 77 is constructed by a pair of ring members 72 and 72, large-diameter gears 72G and 72G which are respectively formed on the outer peripheries of a pair of ring members 72 and 72, a shaft 77A which is mounted on a base plate 78, small-diameter gears 77G and 77G which are fixed to the shaft 77A and are respectively meshed with the large-diameter gears 72G and 72G, an air motor 75B as an explosion-proof type prime mover being a drive device which rotationally drives the shaft 77A, and the like.

By reciprocally rotating the shaft 77A with the air motor 75B, the blast head 71 can be reciprocally moved along the circumferential direction of the outer surface of the pipe P via the small-diameter gears 77G and 77G, the large-diameter gears 72G and 72G, the longitudinally driving device 74 and the like.

The ring member 72 has its inside diameter formed to be slightly larger than the outside diameter of the pipe P, and is constructed by one member 72A and the other member 72B which are formed by dividing the entire ring member into two. The one member 72A and the other member 72B are set to the pipe P, and are connected with the two latch fasteners 13 and 13.

Magnet stands 79 and 79 each having a V-shaped notch are mounted at both end sides of the base plate 78, and by switching a lever 79*a* of the magnet stand 79, the base plate 78 can be attached to and detached from the outer surface of the pipe P.

Since the ring member 72 is divided into two as described above, when setting is changed in the longitudinal direction past the support portion which supports the long pipe P, setting can be changed by dividing the ring member 72, and therefore setting can be easily changed.

Next, an operation of the blasting apparatus 10B for an outer surface of a pipe constructed as above will be described. First, the one members 72A and 72A of a pair of ring members 72 and 72 are attached to a region of the pipe P to be blasting-treated. At this time, they are mounted with the blast head 71 and the longitudinally driving device 74 mounted to the one members 72A and 72A. Next, the other members 72B and 72B of the ring members 72 and 72 are combined with the one members 72A and 72A, and are respectively connected with the latch fasteners 13 and 13 to make a pair of ring members 72 and 72.

Next, the magnet stands 79 and 79 of the base plate 78 are caused to abut on the outer surface of the pipe P so that the small-diameter gears 77G and 77G mounted on the base plate 78 are meshed with the large-diameter gears 72G and 72G, the lever 79*a* of the magnet stand 79 is switched to fix the base plate 78 to the outer surface of the pipe P.

This completes setting of the blasting apparatus 10B for an outer surface of a pipe to the pipe P, the operation of each part is controlled by a control device, and automatic operation of blasting treatment is started. First, the blast media 26 are ejected to the outer surface of the pipe P from the nozzle 38 and the used blast media 26 and the dust particles are sucked from the suction port 50. In parallel with this, the feed screw 74A is rotationally driven by the air motor 75A, and the blast head 71 is moved along the longitudinal direction of the outer surface of the pipe P.

Since the seal member 71*a* made of the elastic member such as rubber is mounted to the region of the blast head 71, which is opposed to the outer surface of the pipe P, the blast media and the dust particles inside the blast head 71 are prevented from spouting outside at this time. While the blast head 71 moves in the longitudinal direction, the ring members 72 and 72 are restrained from rotating in the circumferential direction by holding torque of the air motor 75B.

A terminal sensor not shown is provided at a stroke end in the longitudinal direction, and detects the stroke end in the longitudinal direction of the blast head 71. When the stroke end in the longitudinal direction is detected, the small-diameter gears 77G and 77G are rotated a predetermined angle by the air motor 75B next, and the blast head 71 is rotated by a predetermined amount in the circumferential direction of the pipe P together with a pair of ring members 72 and 72. The rotation amount is set in accordance with the blast width in the circumferential direction.

When the rotation in the circumferential direction is finished, the blast head 71 is moved to a stroke end in the opposite direction along the longitudinal direction of the outer surface of the pipe P by the reverse rotation of the air motor 75A while performing blasting treatment. A terminal sensor is also provided at the stroke end at this side, and detects the stroke end.

When the stroke end in the opposite direction is detected, the blast head 71 is further rotated by the predetermined amount in the circumferential direction of the pipe P, and the operation is repeated. When all the portions in the circumferential direction of the pipe P is blasting-treated in this manner, the blasting apparatus 10B for an outer surface of a pipe is moved to an untreated position in the longitudinal direction of the pipe P. At this time, the ring members 72 and 72 has the structure in which they are divided into two, and therefore, even when setting is changed in the longitudinal direction past the support portion which supports the pipe P, setting can be easily changed.

Since the illuminating device 92 which illuminates the base of the ground outer surface of the pipe P, and the image pickup device 91 which picks up an image of the base of the outer surface of the pipe P illuminated by the illuminating device 92 are provided inside the blast head 71, the image of the base of the outer surface of the pipe P after blasting is picked up, and the rust removal degree and the ground state are observed. The finished state may be recorded, and the finished state may be compared with a sample and automatically judged.

Figure 7:
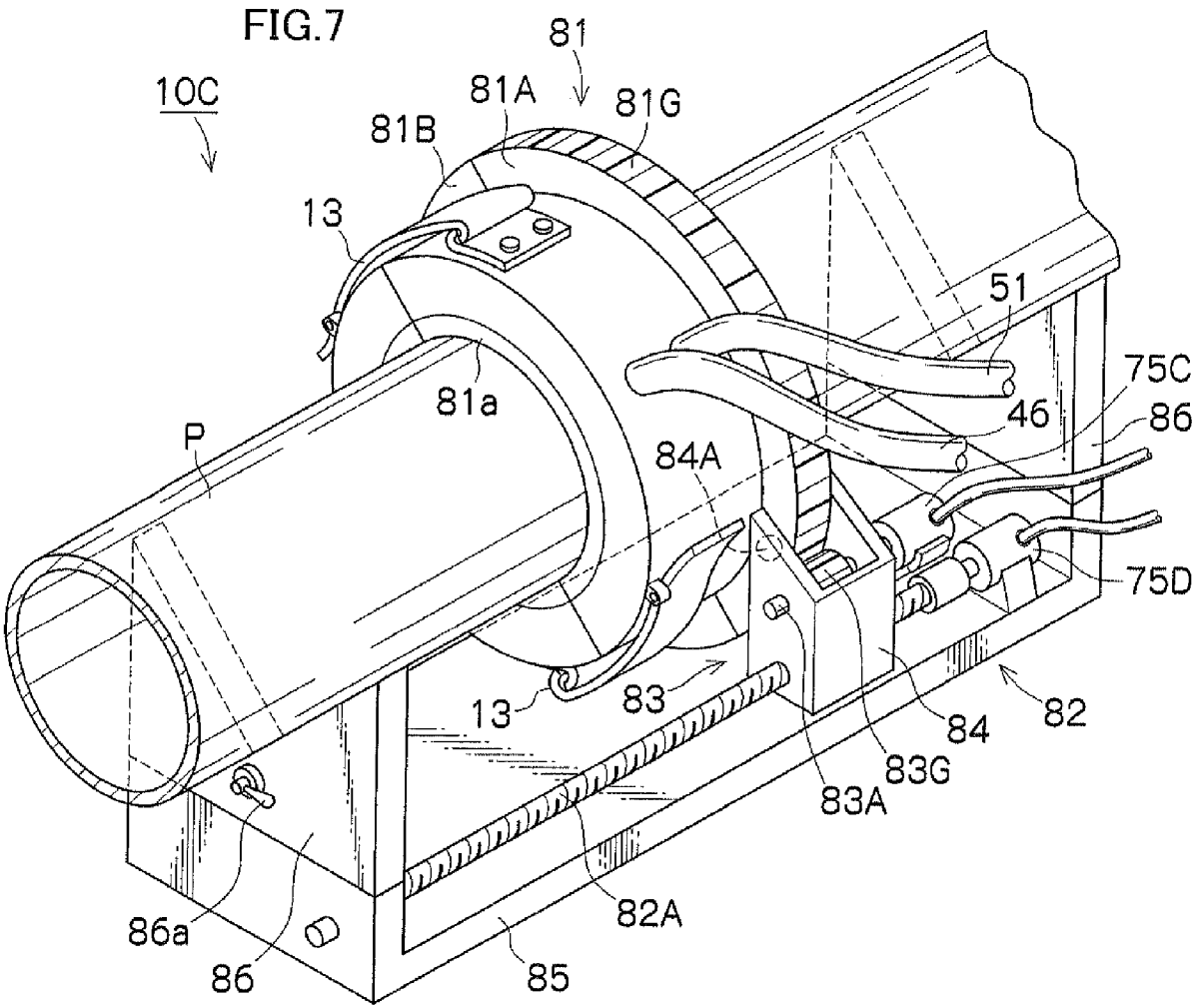
FIG. 7 is a perspective view showing a blasting apparatus for an outer surface of a pipe according to a fourth embodiment of the present invention.
Figure 8:
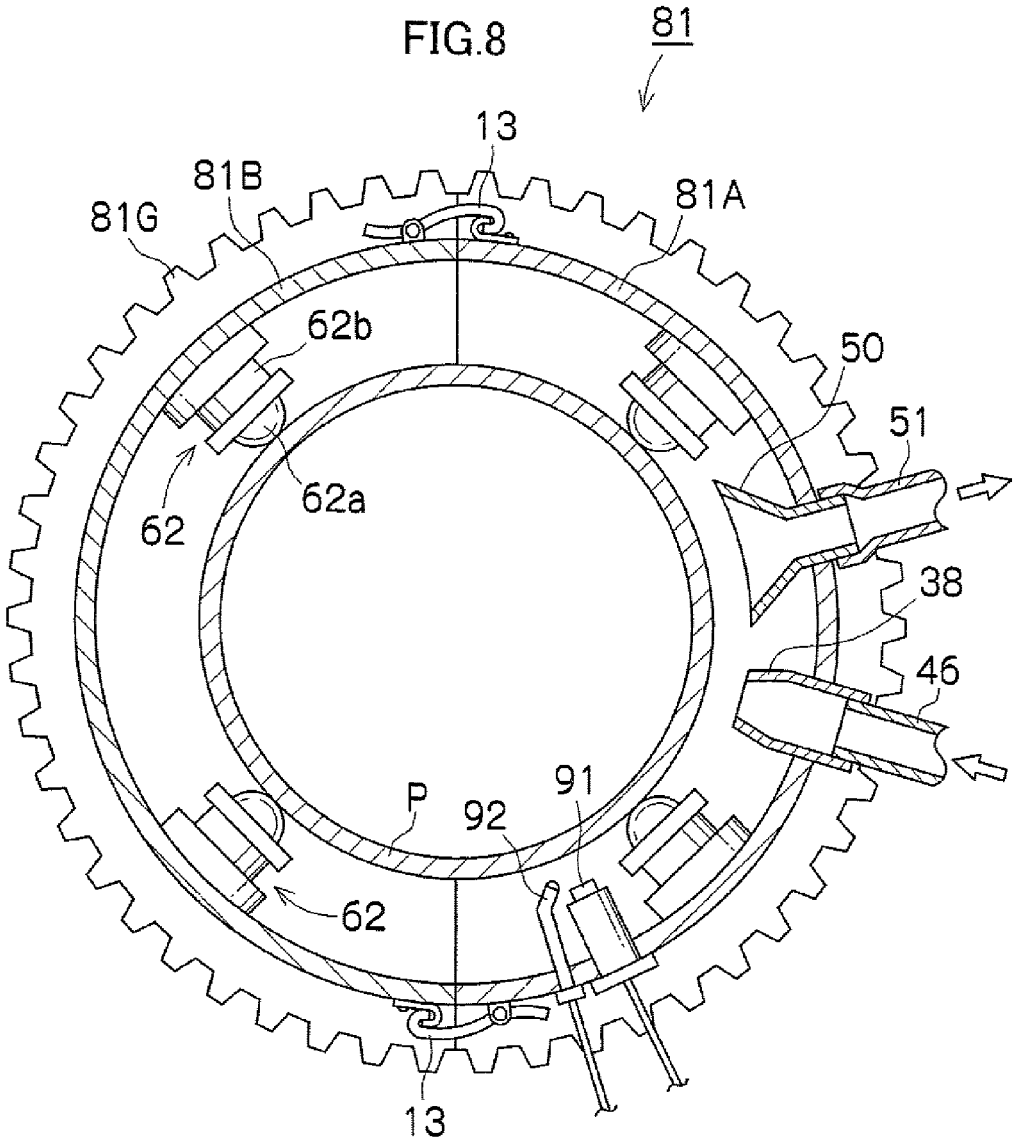
FIG. 8 is a perspective view showing a blasting apparatus for an outer surface of a pipe according to the fourth embodiment of the present invention.

Next, a fourth embodiment will be described. FIGS. 7 and 8 show the fourth embodiment, FIG. 7 is a perspective view, and FIG. 8 is a sectional view. A blasting apparatus 10C for an outer surface of a pipe according to the fourth embodiment is constructed by a blast head 81, a base plate 85, a longitudinally driving device 82 which moves the blast head 81 along the longitudinal direction of the outer surface of the pipe P, a circumferentially driving device 83 which moves the blast head 81 along the circumferential direction of the outer surface of the pipe P, a control device not shown which controls the operation of each part and the like.

As shown in FIG. 8, eight spherical rolling seats 62, 62 in total which are placed in two rows in the longitudinal direction at each of the positions where the circumference is divided into four equal parts on the circumference are provided in the casing of the blast head 81. A spherical body 62*a* of each of the spherical rolling seats 62 is caused to abut on the outer surface of the pipe P via an elastic member 62*b*, and the blast head 81 is supported movably in the longitudinal direction and the circumferential direction of outer surface of the pipe P. A large-diameter gear 81G is formed at one end surface side of the blast head 81.

The blast head 81 is constructed by one member 81A and the other member 81B which are formed by dividing the entire blast head 81 into two. The one member 81A and the other member 81B are set to the pipe P, and are connected with the two latch fasteners 13 and 13.

The nozzle 38 and the suction port 50 of the sponge blasting apparatus 20 are mounted inside the casing of the blast head 81. The nozzle 38 is connected to the flexible hose 46, and ejects the sponge blast 26 to the outer surface of the pipe P from its tip end. The suction port 50 is connected to the flexible hose 51, and sucks the used blast media 26 and fed them to the recycle separator 42 via the suction machine 40.

A seal member 81*a* made of an elastic material such as rubber is mounted to the region of the blast head 81, which is in contact with the outer surface of the pipe P. Further, the image pickup device 91 and the illuminating device 92 are mounted in the casing of the blast head 81.

As shown in FIG. 7, the longitudinally driving device 82 is constructed by a feed screw 82A which is mounted to a base plate 85, a feed nut 84 which is threadedly fitted onto the feed screw 82A and is connected to the blast head 81, an air motor 75D as explosion-proof power being a drive device which rotationally drives the feed screw 82A, and the like.

The feed nut 84 holds a side surface of the large-diameter gear 81G of the blast head 81 which will be described later with two balls 84A and 84A, and its bottom surface contacts the base plate 85 to act as a detent, and by reciprocally rotating the feed screw 82A with the air motor 75D, the blast head 81 can be reciprocally moved along the longitudinal direction of the outer surface of the pipe P.

As shown in FIG. 7, the circumferentially driving device 83 is constructed by the large-diameter gear 81G formed integrally with the blast head 81, a shaft 83A mounted to the feed nut 84, a small-diameter gear 83G which is fixed to the shaft 83A and is meshed with the large-diameter gear 81G fixed to the shaft 83A, an air motor 75C as explosion-proof power being a drive device which rotationally drives the shaft 83A, and the like.

By reciprocally rotating the shaft 83A with the air motor 75C, the blast head 81 can be reciprocally moved along the circumferential direction of the outer surface of the pipe P via the small-diameter gear 83G and the large-diameter gear 81G. While the blast head 81 moves in the longitudinal direction, it is restrained from rotating in the circumferential direction by holding torque of the air motor 75C.

Magnet stands 86 and 86 each having a V-shaped notch are mounted at both end sides of the base plate 85, and by switching a lever 86*a* of the magnet stand 86, the base plate 85 can be attached to and detached from the outer surface of the pipe P.

Since the blast head 81 is divided into two as described above, when setting is changed in the longitudinal direction past the support portion which supports the long pipe P, setting can be changed by dividing the blast head 81, and therefore, setting can be easily changed.

As described above, according to the blasting apparatus for an outer surface of a pipe, the outer surface of a pipe can be ground efficiently with favorable operability.

In the above described embodiments, the explanation is made with an example of the sponge blasting apparatus using the blast medium 26 in a sponge piece form in which abrasives are stuck in a porous elastic body is used as the blast material, but the present invention is not limited to this, and a large effect can be also obtained when the present invention is applied to steel grit blasting in which a blast material 22 such as steel grit is directly ejected without containing it in a medium, and sand blasting in which sand is ejected.

The feed screws 74A and 82A and the feed nuts 76 and 84 are used as the mechanisms for the longitudinally driving devices 74 and 82 which move the blast heads in the longitudinal direction of the pipe P, but the other known mechanisms such as a rack and pinion mechanism and the like can be used. The large-diameter gears 72G and 81G and the small-diameter gears 77G and 83G are used as the circumferentially driving devices 77 and 83, but the other known mechanisms such as a belt mechanisms and the like can be used. Further, the air motor with air as power is used as the drive device, but an explosion-proof type electric motor can be used.

What is claimed is:

1. A blasting apparatus for an outer surface of a pipe which ejects a blast material to an outer side of a pipe and grinds the outer surface comprising:

a guide member which is provided along a longitudinal direction of the outer surface of the pipe, and guides the blast head along the longitudinal direction of the outer surface of the pipe;

a ring member formed of at least two connected half-split members and having an inside diameter that is larger than an outside diameter of the pipe, and which is disposed to have the pipe inserted through the ring member, holds the guide member, and guides the blast head in a circumferential direction of the outer surface of the pipe by turning in the circumferential direction on the outer surface of the pipe; and a blast heat containing a suction port which sucks in a blast material for use in grinding and dust particles, and a nozzle which ejects the blast material, wherein the blast head is mounted for movement in longitudinal and circumferential directions of the pipe.

2. The blasting apparatus for an outer surface of a pipe according to claim 1, further comprising:

a longitudinally driving device which moves the blast head along the longitudinal direction of the outer surface of the pipe; and a circumferentially driving device which moves the blast head along the circumferential direction of the outer surface of the pipe, wherein the longitudinally driving device comprises one guide member, one feed screw provided parallel with the one guide member, a nut which is threadedly fitted onto the feed screw and connected to the blast head, and a drive device which rotationally drives the feed screw, and wherein the circumferentially driving device comprises the ring member, a large-diameter gear provided integrally with the ring member, a small-diameter gear which is meshed with the large-diameter gear, and a drive device which rotationally drives the small-diameter gear.

3. The blasting apparatus for an outer surface of a pipe according to claim 2, further comprising:

an illuminating device which illuminates a base of the outer surface of the pipe ground by the blast material; and an image pickup device which picks up an image of the base of the outer surface of the pipe illuminated by the illuminating device.

4. The blasting apparatus for an outer surface of a pipe according to claim 3, wherein the blast material is a blast medium in a sponge piece form in which abrasives are contained in a porous elastic body.

5. The blasting apparatus for an outer surface of a pipe according to claim 2, wherein the blast material is a blast medium in a sponge piece form in which abrasives are contained in a porous elastic body.

6. The blasting apparatus for an outer surface of a pipe according to claim 1, further comprising:

an illuminating device which illuminates a base of the outer surface of the pipe ground by the blast material; and an image pickup device which picks up an image of the base of the outer surface of the pipe illuminated by the illuminating device.

7. The blasting apparatus for an outer surface of a pipe according to claim 6, wherein the blast material is a blast medium in a sponge piece form in which abrasives are contained in a porous elastic body.

8. The blasting apparatus for an outer surface of a pipe according to claim 1, wherein the blast material is a blast medium in a sponge piece form in which abrasives are contained in a porous elastic body.

* * * * *